US005147573A

United States Patent [19]

Chagnon

[11] Patent Number: 5,147,573

[45] Date of Patent: Sep. 15, 1992

[54] SUPERPARAMAGNETIC LIQUID COLLOIDS

[75] Inventor: Mark S. Chagnon, Lowell, Mass.

[73] Assignee: Omni Quest Corporation, Lawrence, Mass.

[21] Appl. No.: 617,956

[22] Filed: Nov. 26, 1990

[51] Int. Cl.[5] ..... H01F 1/28; H01F 1/20

[52] U.S. Cl. ..... 252/62.52; 252/62.51; 252/518; 252/519; 252/520

[58] Field of Search ..... 252/62.51, 62.52, 74, 252/507, 519, 520, 513, 521, 518; 427/213.3, 220

[56] References Cited

U.S. PATENT DOCUMENTS

| | | | |
|---|---|---|---|
| 2,751,352 | 6/1956 | Bondi | 252/62.52 |
| 3,700,595 | 10/1972 | Kaiser | 252/62.56 |
| 3,917,538 | 11/1975 | Rosenweig | 252/62.51 |
| 3,981,844 | 9/1976 | Romankiw | 252/62.51 |
| 4,208,294 | 6/1980 | Khalafalla | 252/62.52 |
| 4,315,827 | 2/1982 | Bottenberg et al. | 252/62.51 |
| 4,356,098 | 10/1982 | Chagnon | 252/62.51 |
| 4,374,760 | 2/1983 | Charles | 252/518 |
| 4,430,239 | 2/1984 | Wyman | 252/62.51 |
| 4,485,024 | 11/1984 | Furumura et al. | 252/62.51 |
| 4,488,987 | 12/1984 | Hocker et al. | 252/518 |
| 4,604,222 | 8/1986 | Borduz et al. | 252/62.51 |
| 4,604,229 | 8/1986 | Raj et al. | 252/62.51 |
| 4,624,797 | 11/1968 | Wakayama et al. | 252/62.52 |
| 4,673,997 | 6/1987 | Gowda et al. | 252/62.52 |
| 4,867,910 | 9/1989 | Meguro et al. | 252/519 |

FOREIGN PATENT DOCUMENTS

| | | | |
|---|---|---|---|
| 3737909 | 5/1988 | Denmark . | |
| 3709852 | 10/1988 | Denmark . | |
| 0208391 | 3/1986 | European Pat. Off. . | |
| 74747 | 5/1983 | Japan | 252/507 |
| 131503 | 6/1988 | Japan | 252/62.51 |

OTHER PUBLICATIONS

Dunlop, *Journal of Geophysical Research,* vol. 78, No. 11 Apr. 10, 1973, pp. 1780–1793.

*Metal Alkoxides,* Bradley et al., Academic Press, 1978, pp. 310–314.

*GAF Chemicals,* GAF Corporation, 1986.

Chemical Abstracts, vol. 97, No. 20, Nov. 1982, (Columbus, Ohio US) see p. 754 abstract 173809b, & SU, A, 947052(All-Union Scientific Research Institute for Gas-Processing) Jul. 30, 1982.

*Primary Examiner*—Michael Lewis

*Assistant Examiner*—Stephen G. Kalinchak

*Attorney, Agent, or Firm*—Hayes, Soloway, Hennessey & Hage

[57] ABSTRACT

Electrically-conductive superparamagnetic liquid colloids and methods for making and using them are described. The magnetic liquid colloids contain magnetic particles coated with conductive, organio-metallic compund, which impart the magnetic and conductive characteristics to the fluid. The coated magnetic particles are dispersed in a carrier fluid that gives the fluid viscosity, flow and vapor pressure properties.

28 Claims, No Drawings

SUPERPARAMAGNETIC LIQUID COLLOIDS

This is a continuation of co-pending application Ser. No. 07/361,230 filed on Jun. 5, 1989 now abandoned.

BACKGROUND

Magnetic colloids are liquids having magnetic properties in which ferromagnetic materials are collodially suspended. Such ferrofluids or magnetic liquids must show a high degree of stability (e.g., to gravitational and magnetic fields) in order to perform well in various commercial devices and be responsive to external magnetic fields. Generally a stable magnetic colloid or ferrofluid in a high magnetic field gradient requires small ferromagnetic particles of generally less than 200 angstroms in diameter. The ferromagnetic particles are usually coated with one of several layers of surfactants to prevent agglomeration.

Typical ferrofluid compositions are described, for example, in U.S. Pat. No. 3,700,595, (1972), wherein anionic surfactants, such as fatty acids, alcohols, amines or amides and other organic acids are employed as dispersing surface active agents; U.S. Pat. No. 3,764,504, (1973), wherein aliphatic monocarboxylic acids are employed as dispersing agents; U.S. Pat. No. 4,208,294, (1980), wherein a water-based magnetic liquid is produced using $C_{10}$ to $C_{11}$ aliphatic monocarboxylic acids as acid dispersing agents; and U.S. Pat. No. 4,430,239, (1984), wherein a stable ferrofluid composition is provided which employs a phosphoric acid ester of a long-chain alcohol as a surfactant.

Various processes have been described for preparing magnetic colloids and ferrofluids. For example, U S. Pat. No 3,917,538, (1975) describes a process for preparing an irreversibly flocked magnetic particle using different dispersing agents, such as nonionic and anionic surfactants, and wherein the ferrofluids are prepared employing a grinding or ball mill technique; U.S. Pat. No. 4,019,994, (1977) describes a petroleum sulfonate surfactant with an aqueous carrier; U.S Pat. No. 4,356,098, (1982) describes ferrofluid compositions composed of a silicone-oil carrier and a dispersing amount of an anionic surfactant which forms a chemical bond with the surface of the magnetic particles as a tail group compatible with or soluble in the silicon-oil carrier; and U.S. Pat. No. 4,485,024, (1984), describes a ferrofluid produced by controlling the pH of an aqueous suspension of the ferromagnetic particles of an organic solvent together with surface active agents, such as fatty carboxylic acids.

A properly stabilized ferrofluid composition typically undergoes practically no aging or separation, remains liquid in a magnetic field and after removing of the magnetic field shows no hysteresis. A stabilized ferrofluid exhibits stability by overcoming generally three principal attractive forces; van der Waals, interparticle-magnetics and gravitational forces.

In the computer industry, static charge build up of the disk in a disk drive occurs due to its rotation and needs to be grounded. In addition, the disk cavity must be hermetically sealed for contamination-free operation. Electrically conductive ferrofluids which contain finely divided dispersed carbon particles are useful for this purpose however, there is a need to restrict the amount of carbon black employed in the ferrofluid compositions to avoid gradual increases in the viscosity of the composition and absorption of the fluid into the carbon particles with time. The addition of carbon black to a typical ferrofluid composition provides a composition which tends to be pseudoplastic when amounts greater than about five (5%) percent of carbon black are used, while a low concentration of carbon black (e.g., less than 5%) provides a Newtonian, non-conductive composition. A stable, low viscosity, highly electrically conductive ferrofluid composition is needed, with or without carbon black, particularly for use in computer seals, as well as for other devices where a stable, low viscosity, highly electrically conductive ferrofluid composition is required.

SUMMARY OF THE INVENTION

The present invention relates to low viscosity, electrically conductive magnetic fluid compositions and methods of preparing and using such compositions. The present composition contains magnetic particles, an electrically conductive surfactant, a dispersing agent and a carrier fluid. The compositions are made by coating the magnetic particles with the electrically conductive surfactant, adding a dispersing agent and dispersing the coated particles in the carrier fluid, thereby forming a gravitationally and magnetically stable colloidal dispersion. The present compositions are superparamagnetic, that is, they do not retain magnetic properties once the magnetic field has been removed. The present magnetic fluids provide stable, low viscosity highly conductive compositions which are useful as liquid seals for computer disk drives and other applications.

DETAILED DESCRIPTION OF THE INVENTION

The colloidal dispersions of the present invention are superparamagnetic, that is, they experience force in a magnetic field gradient but do not become permanently magnetized. Superparamagnetic particles rapidly lose their magnetic properties in the absence of an applied magnetic field, yet they also possess high susceptibility to magnetic fields. Thus, superparamagnetic particles are easy to handle since they are sensitive to magnetic field gradients, and resist aggregating after removal of an external magnetic field.

The present compositions are stable colloidal dispersions of superparamagnetic particles. The term "colloidal dispersion" or "colloid" as used herein refers to a gravitationally and magnetically stable dispersion of finely divided magnetic particles of submicron size in a carrier fluid, which particles remain substantially uniformly dispersed throughout the liquid carrier even in the presence of a magnetic field, and which resist gravitational settling.

The compositions which are the subject of the present invention contain magnetic particles which are coated with an electrically conductive surfactant and dispersed in a carrier fluid with a dispersing or suspending agent, which agent helps to maintain the stability of the colloid.

Magnetic particles which are useful in the present composition are metal, metal alloy or metal oxide particles comprised of clusters of superparamagnetic crystals. Metals and oxides of metals which appear in the Periodic Table in Groups 4*a* and *b*, 5*a* and *b*, 6*a* and 7*a* (the transition metals) can be used to make the magnetic particles. Compounds which are particularly useful include those selected from the group consisting of magnetite ($Fe_3O_4$), hematite ($Fe_2O_3$), iron, iron alloys, nickel, cobalt, cobalt ferrite, samarium cobalt, barium ferrite, chromium dioxide, aluminum-nickel-cobalt alloys and gadolinium. The average particle size depends on the selection of the ferromagnetic materials, and generally ranges from about 20 angstroms (Å) to about 500 angstroms (Å). For use in a very high magnetic field gradient, particle sizes of from bout 95 Å to 105 Å are particularly preferred for use in the present compositions. The ferromagnetic particles are generally present in the composition in an amount ranging from about 5 to about 80% percent by weight of the carrier fluid.

An electrically conductive surface active agent (surfactant) is adsorbed as a conductive shell around the magnetic particle. The electrically conductive surfactant should have a conductivity of less than about $1\times10^{-10}$ ohms/cm$^2$, preferably less than $1\times10^{-6}$ ohms/cm$^2$. Compounds useful as the electrically conductive surfactant include alkyl or alkoxide organometallic compounds. Particularly useful surfactants are those selected from the group consisting of tetraethoxy titanium, triethylcarboxyhexyl antimony tin, triethylaminohexyl titanium, tetraethyl titanium, triethylcarboxyhexyl titanium, triethylcarboxyhexyl hafnium, tetraethyl antimony, tetraethyl antimony tin, triethylcarboxyhexyl zirconium, tetraethyl hafnium, tetraethyl tin, titanium tetraisopropoxide, antimony titanium tetraisopropoxide, Mitsubishi T1 powder (Mitsubishi Corp.) and combinations thereof.

A dispersing or suspending agent is employed to disperse the particles in the carrier fluid and to add stability to the colloid. Surfactants can be used as dispersing or suspending agents. Any surfactant may be employed which forms a stable colloid, including nonionic, cationic or anionic surfactants. The amount and nature of the surfactant varies depending on the particular liquid carriers used, the type and size of the ferromagnetic particles and the type and stability of the dispersion desired. The ratio of the dispersing agent to the magnetic particles may vary, but a ratio of from about 0.5:1 to 20:1 by weight is generally used.

Materials which are particularly useful as dispersing agents include surfactants which are ionic organic materials having the general structure:

$$R''-R'-R-YH$$

wherein:

YH is an adsorptive head region;

R is an organic spacer arm region;

R' is an electron-rich organic function; and

R'' is a solubilizing tail;

wherein YH is a polar functional group that bonds by means of covalent linkage, chemisorption, adsorption, or ionic interaction to the surface of the magnetic particle. YH can be, for example, a functional group selected from the group consisting of: carboxylate ($COO^-$), amide ($NH_2$), sulfate ($SO_3$), phosphate ($PO_3$), metal chloride salts ($M^+Cl^-$) (e.g., examples) and thiol (SH). The carboxylate group can be mono-, di- or trisubstituted on the terminal carbon atom, such as:

$$R-CH_2-COOH \quad (a)$$

$$R-CH(COOH)_2 \quad (b)$$

$$R-C(COOH)_3, \quad (c)$$

or can be a single or mixed species, such as:

$$R-CH(COOH)_2 \quad (a)$$

or $$R-\underset{\underset{NH_2}{|}}{CH}-COOH. \quad (b)$$

Where YH is a cation or anion, it is most effective when the charge of YH is the same magnitude and/or opposite sign to the surface charge on the particle being dispersed.

R is an aliphatic chain ($C_4$ to $C_{20}$), aromatic ring or a cyclic aliphatic group. Addition of polar functional groups along the chain (such as primary hydroxyls) can result in stronger interactions between YH and the particle by acting as additional YH adsorption sites or by increasing the ionization of the YH group. If R is aliphatic, the length of the R chain is useful in changing the magnitude of the charge on YH. R is preferably an aliphatic chain of from about $(CH_2)_4$ to about $(CH_2)_{20}$.

R' is a linking group that causes a change in electron density, separating the polar R-YH portion of the molecule from the nonpolar tail. R' is generally a linking group selected from the group consisting of: a carbon-carbon double bond (C=C), an ether linkage (—O—), a phenyl group, a secondary amine group (—NH—) and a sulfur atom (—S—).

R'' is a hydrophobic tail that has a similar solubility parameter to the carrier fluid and is of sufficient chain length to separate the magnetic particles, so that no particle/particle magnetic field interference occurs. R'' is generally, but not exclusively, an aliphatic chain ($C_x$ to $C_y$) which can have one or more carbon-carbon double bonds, wherein x is about 4 and y is about 30.

It has been found that stable colloidal dispersions of magnetite can be formed using surfactants that adhere to the model. For example, colloidal dispersions in perfluorinated liquids can be formed by utilizing as a dispersing agent a fluorocarbon sufactant having the following formula:

$$F-\left[\begin{array}{c} CF_3 \\ | \\ C \\ | \\ F \end{array}-CF_2-O-\begin{array}{c} CF_3 \\ | \\ C \\ | \\ F \end{array}\right]_n-YH$$

where n is an integer from 3 to 50 preferably 5 to 25; and where YH is COOH, —OH, —$OONH_4$, —$ONH_2$, —$NH_2$, with COOH being preferred.

Dispersing agents which are useful in the present composition include, for example, oleic acid and synthetic surfactants such as GAFAC RM410 (GAF Corp.), and Paranox 100 (Exxon Corp.)

The relative proportions of the dispersing agent to the suspended solids can vary widely so long as there is a sufficient concentration of the surfactant component to provide at least a mono-molecular covering of the particles in suspension. The numerical limits in proportions are broad, and dependent on other factors (e.g., particle size, density, etc.). The proportions of dispersing agent to the particles can be, for example, a useful range for forming stable suspension of particles is a ratio of dispersing agent to the particles of from about 0.5:1 to about 20:1 by weight. The amount of surfactant present in the composition is generally from about 5% to about 10% by weight, of the total composition.

The present composition is formed by dispersing the particles, which have been coated with the organometallic surfactant and the dispersing agent, in a carrier fluid that forms the continuous phase of the colloid composition. Carrier fluids which provide properties that are useful for the end applications, and exhibit a similar solubility parameter to the R'' surfactant tail, can be used in the present invention. Materials that are useful as carrier liquids, for example, are compounds selected from the group consisting of: water, hydrocarbon solvents having from about 4 to about 40 carbon atoms, fluoroethers, ester or diester oils and α-olefins. Examples of fluoroethers which can be used as carrier fluids include Freon E-3, Freon E-5 and Freon E-9, Krytox AA, AB, AC, AD, and Krytox 143, all available from DuFont. Particularly preferred carrier fluids include toluene, and low vapor-pressure oils such as α-olefin oils, di-2-ethylhexyl azylate, dioctyl azylate, dioctyl sebacate and dioctyl adipate.

The present colloids can be made according to the following general procedure: the metallic magnetic particles are made and contacted with the organometallic surfactant under conditions sufficient to cause the surfactant to adsorb or bond to the surface of the particle. The coated particles are then contacted with the dispersing agent under conditions sufficient to coat the particles with the dispersing agent, and then contacted with a carrier fluid and agitated to form a dispersion.

Magnetic particles used in the present compositions can be produced according to the following general procedure: an aqueous slurry is formed of the magnetic particles by contacting a metallic salt (e.g., $FeCl_2$) with water, and adding a strong base, such as ammonium hydroxide ($NH_4OH$) causing the metal to precipitate forming a slurry. The mixture is agitated, at a temperature of about 25 to about 40° C. After the addition of the base is complete, the slurry containing the metal particles is allowed to cool to room temperature.

An alternate method for preparing superparamagnetic particles is based on precipitation of iron metal from an aqueous iron chloride, nitrate or sulfate solution. In this method, about 10 g of sodium borohydride powder is added to about 100 ml of 95% (by weight) aqueous solution of ferrous chloride ($FeCl_2$) under constant agitation, the mixture is kept at a temperature of about 25-90° C. during the addition of the sodium borohydride. After all of the reagents have been added, the particles are removed from the reaction mixture by addition of an external magnetic field. The particles are washed with 5 100 ml portions of distilled water and then used as the magnetite in the preparation of the fluid.

Another embodiment of the method of preparing superparamagnetic particles is to grind commercial magnetite (Pfizer) for 30 days as an aqueous or hydrocarbon slurry using a ball mill, washing the resulting particles and treating as previously described to prepare the magnetite fluid.

The electrically conductive compound is added to the aqueous slurry, and the mixture is stirred to allow the metal particles to be coated with the compound. The dispersing or suspending agent, (e.g., oleic acid) is added to the mixture, and the mixture is heated, while stirring, to about 70° C., for about 30 minutes. The carrier fluid, (e.g., toluene). is then added to the mixture, forming a stable colloid.

The ferrofluid compositions of the present invention have varying saturation magnetization values, which may range from about 10 to about 800 gauss Values of about 100 to about 500 gauss are particularly useful. The viscosity of the compositions is generally from about 1 to 10,000 centipoises (cps) at 25° C.; viscosities at 25° C. of about 25 to about 5,000 cps are preferred. The conductivity of the present compositions is generally less than $1\times10^{-7}$ ohms/cm$^2$.

Preferred magnetic liquid compositions having improved electrical conductivity contain:

1) Ferromagnetic particles, such as iron (Fe), about 15 to about 40% by weight, preferably about 28% by weight;
2) Conductive organometallic coatings adsorbed, or covalently bonded, to the surface of the magnetic particle to provide a conductive path;
3) An organic surfactant in a concentration of from 5-10% by weight, as a dispersing agent and to stabilize the organometallic coated magnetic particles; and
4) A low vapor pressure oil carrier fluid.

The present compositions are useful as ferrolubricants for bearings and as a ferrofluid composition in seals. The present ferrofluid compositions can be used in a wide variety of commercial applications such as for magnetic seals, as dampening liquids in inertia dampers. as heat transfer liquids in the voice coil loudspeakers, as bearing liquids, as ferrolubricants for domain detection, for oil prospecting and other applications. The present electrically conductive ferrofluid compositions are particularly useful in computer disk drive applications. For example, the present composition is placed around the shaft in the disk drive mechanism, where it forms a hermetically sealed, liquid sealing ring, which also conducts electrical charges away from the shaft so as to prevent charge build up on the disk.

The invention is further illustrated by the following examples.

EXAMPLE 1

Magnetite Preparation 200 grams of ferrous chloride (VWR Scientific) and 325 grams of ferric chloride were dissolved in 3 liters of water, 2,000 grams of ammonium hydroxide (VWR Scientific) concentrate were added at a rate of 50 cc/minute under constant agitation, during which time the temperature of the solution was kept between 25 and 40° C. After the addition of the ammonium hydroxide was complete the magnetic particle aqueous slurry was allowed to cool to room temperature.

EXAMPLE 2

Conductivity Agent and Surfactant Addition 40 grams of the conductive organometallic compound carboxyhexyltriethyl antimony tin were added to the aqueous slurry prepared as described in Example 1. The mixture was stirred for a period of 5 minutes to insure complete adsorption of the conductive organometallic compound to the surface of the particles, 40 grams of oleic acid (VWR Scientific) were then added to the mixture and the mixture was stirred for 30 minutes and heated to a temperature of 70° C. during that period. At the conclusion of the 30 minute reaction period, 100 ml of toluene were added to the mixture and the resulting toluene-based ferrofluid was extracted from the reaction vessel. The product had a magnetization of 350 gauss and a conductivity of $3\times10^{-5}$ ohms/cm$^2$.

EXAMPLE 3

A magnetic fluid was prepared as described in Examples 1 and 2, but a synthetic surfactant, omega carboxy-6-mono butyl ether dihexyl adipate, having the following chemical composition:

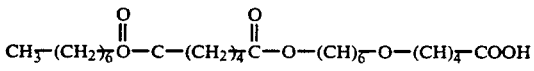

(IMI DHA 04-C; Integrated Magnetics, Inc., Lawrence, Mass.), was used in place of oleic acid. The resulting fluid had a magnetization of 350 gauss and a conductivity of $3\times10^{-5}$ ohms/cm$^2$.

EXAMPLE 4

A magnetic fluid was prepared as described in Examples 1 and 2, except that di-2-ethylhexyl azylate was used as a carrier fluid in place of toluene. The resulting magnetic fluid colloid had a viscosity at 25° C. of 100 cps, a magnetization of 300 gauss and a vapor pressure at 25° C. of $3\times10^{-6}$ torr.

EXAMPLE 5

A magnetic fluid was prepared as in Examples 1 and 2, except that toluene was substituted as a carrier fluid by olefin oil (Mobil-1, Mobil Oil Co ). The resulting magnetic fluid colloid had a viscosity of 200 cps, a vapor pressure at 25° C. of $3\times10^{5}$ torr and a conductivity of $3\times10^{-5}$ ohms/cm$^2$.

EXAMPLE 6

A magnetic fluid was prepared as described in Examples 1 and 2, except that Mitsubishi T-1 powder (Mitsubishi Corp.) was used in place of carboxyhexyltriethyl antimony tin. The resulting magnetic fluid colloid had a magnetization of 350 gauss and a conductivity of $2.5\times10^{-5}$ ohms/cm$^2$.

EQUIVALENTS

Those skilled in the art will recognize, or be able to ascertain, by no more than routine experimentation, many equivalents of the specific embodiments of the invention described herein. Such equivalents are intended to be encompassed by the following claims.

I claim:

1. A colloidal dispersion of electrically conductive magnetic particles consisting essentially of:

a. superparamagnetic magnetic particles;

b. an electrically conductive organometallic compound having a conductivity of less than $1\times10^{-10}$ ohms/cm$^2$ absorbed as a conductive shell around the magnetic particle;

c. a dispersing agent comprising a nonionic, anionic or cationic surfactant; and d. a carrier fluid selected from the groups consisting of: hydrocarbon solvents having from about 4 to 40 carbon atoms, fluoroethers, and ester or diester oils.

2. A magnetic fluid colloid of claim 1, wherein the magnetic particles are composed of a superparamagnetic material selected from the group consisting of: magnetite, hematite, chromium dioxide, barium ferrite, aluminum-nickel-cobalt alloys, samarium cobalt, cobalt ferrite iron, iron alloys, nickel, cobalt and gadolinium.

3. A magnetic fluid colloid of claim 2, wherein the magnetic particles are from about 20 to about 500 angstroms in size.

4. A magnetic fluid colloid of claim 3, wherein the magnetic particles are magnetite particles which are from about 95 to about 105 angstroms in size.

5. A magnetic fluid colloid of claim 1 wherein the electrically conductive organometallic compound coating said particles is selected from the group consisting of: tetraethoxy titanium, tetraethyl titanium, triethylcarboxyhexyl antimony tin, triethylaminohexyl titanium, triethylcarboxyhexyl hafnium, triethylcarboxyhexyl titanium, triethylcarboxyhexyl zirconium, tetraethyl hafnium, tetraethyl tin, tetraethyl antimony, tetraethyl antimony tin, titanium tetraisopropoxide antimony, titanium tetraisopropoxide and combinations thereof.

6. A magnetic fluid colloid of claim 5, wherein the organometallic compound is tetraethyl antimony tin comprising about 1–10% by weight antimony and about 50–90% by weight tin.

7. A magnetic fluid colloid of claim 5, wherein the organometallic compound is triethylcarboxyhexyl antimony tin.

8. A magnetic fluid colloid of claim 1, wherein the dispersing agent is selected from the group consisting of: oleic acid, and omega carboxy-6-mono butylether-dihexyl adipate.

9. A magnetic fluid colloid of claim 1, wherein the dispersing agent is omega carboxy-6-mono butylether-dihexyl adipate.

10. A magnetic fluid colloid of claim 1, wherein the carrier fluid is a diester oil selected from the group consisting of: di-2-ethylhexyl azylate, dioctylazylate, dioctyl sebacate and dioctyl adipate.

11. A magnetic fluid colloid of claim 1, wherein the carrier fluid is toluene.

12. A magnetic fluid colloid of claim 1, having a saturation magnetization of from about 10 to about 800 gauss.

13. A magnetic fluid colloid of claim 1, having a viscosity of from about 1 to about 10,000 centipoises at 25° C.

14. A magnetic fluid colloid of claim 1, having a conductivity of about $1\times10^{-7}$ ohms/cm$^2$.

15. A colloidal dispersion of electrically conductive magnetic particles consisting essentially of:

a. about 3 to about 7% by weight of superparamagnetic particles;

b. about 5 to about 10% by weight of an electrically conductive organometallic compound having a conductivity of less than about $1\times10^{-10}$ ohms/cm$^2$ absorbed as a conductive shell around the magnetic particle;

c. a dispersing agent comprising a nonionic, anionic or cationic surfactant present in a ratio of from about 0.5:1 to about 20:1 to the particles; and d. a carrier fluid selected from the group consisting of: hydrocarbons from $C_4$ to $C_{40}$, fluoroethers, and ester or diester oils.

16. A magnetic liquid composition of claim 15, wherein the magnetic particles are from about 20 to about 500 A in size.

17. A magnetic liquid composition of claim 16, wherein the magnetic particles are composed of a material selected from the group consisting of magnetite, hematite, chromium dioxide, barium ferrite, aluminum, nickel-cobalt alloys, samarium cobalt, cobalt ferrite, iron, iron alloys, nickel, cobalt and gadolinium.

18. A magnetic liquid composition of claim 17, wherein the magnetic particles are magnetite particles.

19. A magnetic liquid composition of claim 15, wherein the electrically conductive organometallic compound is selected from the group consisting of: tetraethoxy titanium, tetraethyl titanium, triethyl carboxyhexyl antimony tin, triethylaminohexyl titanium, triethylcarboxyhexyl hafnium, triethyl carboxyhexyl titanium, triethylcarboxyhexy zirconium, tetraethyl hafnium, tetraethyl tin, tetraethyl antimony, tetraethyl antimony tin, titanium tetaisopropoxide, antimony titanium tetraiso propoxide and combinations thereof.

20. A magnetic liquid composition of claim 19, wherein the organometallic compound is triethylcarboxyhexyl antimony tin.

21. A magnetic liquid composition of claim 15, wherein the dispersing agent is selected from the group consisting of oleic acid and a phosphate ester surfactant.

22. A magnetic liquid composition of claim 15, wherein the carrier fluid is a diester oil selected from the group consisting of: di-2-ethylhexyl azylate, dioctyl azylate, dioctylsebacate and dioctyl adipate.

23. A colloidal dispersion of electrically conductive magnetic particles consisting essentially of:

a. about 3 to about 7% by weight magnetite particles wherein said particles are about 95 to about 105 Å in size;

b. an organometallic compound comprising triethylcarboxyhexyl antimonytin, absorbed as a conductive shell around the magnetic particles;

c. about 5 to 10% weight oleic acid; and d. a carrier fluid comprising di-2-ethylhexyl azylate.

24. A process for producing a colloidal dispersion of electrically conductive magnetic particles comprising the steps of:

a. contacting superparamagnetic submicron-sized magnetic particles with an electrically conductive organometallic surfactant having conductivity of less than about $1\times10^{-10}$ ohms/cm$^2$ and stirring, thereby causing the particles to become coated with the electrically conductive surfactant;

b. contacting the coated particles of step (a) with a dispersing agent comprising a nonionic, anionic or cationic surfactant and heating to a temperature of about 70° C. thereby causing the particles to become coated with the dispersing agent; and c. contacting the coated particles of step (b) with a carrier fluid selected from the group consisting of: hydrocarbon solvents having from about 4 to 40 carbon atoms, fluoroethers, and ester or diester oils, thereby forming a colloidal dispersion of the particles in the carrier fluid.

25. A process of claim 24, wherein the magnetic particles are magnetite particles of between about 95 to about 105 A in size.

26. A process of claim 24, wherein the organometallic surfactant is triethylcarboxyhexyl antimony tin.

27. A process of claim 24, wherein the dispersing agent is oleic acid.

28. A process of claim 24, wherein the carrier fluid is di-2-ethylhexyl azylate.

* * * * *

UNITED STATES PATENT AND TRADEMARK OFFICE

CERTIFICATE OF CORRECTION

PATENT NO. : 5,147,573

DATED : September 15, 1992

INVENTOR(S) : Mark S. Chagnon et al

It is certified that error appears in the above-indentified patent and that said Letters Patent is hereby corrected as shown below:

Cover page, line [75], after "Chagnon", insert --John R. Ferris and Mark S. Friery--.

Claim 23, col. 9, line 31, after "10%", insert --by--.

Signed and Sealed this

Eleventh Day of April, 1995

*Attest:*

*Attesting Officer*

BRUCE LEHMAN

*Commissioner of Patents and Trademarks*